US010443943B2

(12) United States Patent
Taddei et al.

(10) Patent No.: US 10,443,943 B2
(45) Date of Patent: Oct. 15, 2019

(54) APPARATUS AND METHOD TO CONTROL PROPERTIES OF FLUID DISCHARGE VIA REFRIGERATIVE EXHAUST

(71) Applicant: VEECO PRECISION SURFACE PROCESSING LLC, Horsham, PA (US)

(72) Inventors: John Taddei, Jim Thorpe, PA (US); Laura Mauer, South Kent, CT (US); George Chiaverini, Doylestown, PA (US); Jia Li, Dunellen, NJ (US)

(73) Assignee: VEECO PRECISION SURFACE PROCESSING LLC, Horsham, PA (US)

( * ) Notice: Subject to any disclaimer, the term of this patent is extended or adjusted under 35 U.S.C. 154(b) by 286 days.

(21) Appl. No.: 15/472,978

(22) Filed: Mar. 29, 2017

(65) Prior Publication Data

US 2017/0284752 A1 Oct. 5, 2017

Related U.S. Application Data

(60) Provisional application No. 62/314,761, filed on Mar. 29, 2016.

(51) Int. Cl.
*F28F 19/00* (2006.01)
*F28C 3/06* (2006.01)

(52) U.S. Cl.
CPC ..... *F28C 3/06* (2013.01)

(58) Field of Classification Search
CPC ..... F28C 3/06; F02B 33/22; F04D 19/042
USPC ..... 165/11.2
See application file for complete search history.

(56) References Cited

U.S. PATENT DOCUMENTS

| | | | | |
|---|---|---|---|---|
| 6,318,310 | B1 * | 11/2001 | Clarke | F02B 33/22 123/70 R |
| 6,539,952 | B2 | 4/2003 | Itzkowitz | |
| 9,541,837 | B2 | 1/2017 | Taddei et al. | |
| 2007/0169792 | A1 | 7/2007 | Itzkowitz | |
| 2008/0193303 | A1 * | 8/2008 | Stones | F04D 19/042 417/251 |
| 2014/0242731 | A1 | 8/2014 | Mauer et al. | |
| 2015/0040952 | A1 | 2/2015 | Regan et al. | |

* cited by examiner

*Primary Examiner* — Davis D Hwu
(74) *Attorney, Agent, or Firm* — Leason Ellis LLP

(57) ABSTRACT

An apparatus and method for controlling fluid discharge temperature on a semiconductor manufacturing tool. In this technique, the temperature is controlled via the use of refrigerative exhaust. This embodiment includes the hardware and controls to perform and monitor the described operation.

16 Claims, 2 Drawing Sheets

APPARATUS AND METHOD TO CONTROL PROPERTIES OF FLUID DISCHARGE VIA REFRIGERATIVE EXHAUST

CROSS REFERENCE TO RELATED APPLICATION

The present application claims priority to U.S. patent application Ser. No. 62/314,761, filed Mar. 29, 2016, which is hereby incorporated by reference in its entirety.

TECHNICAL FIELD

The present embodiment generally relates to an apparatus and method to control fluid discharge temperature on a semiconductor manufacturing tool. More specifically, it relates to an apparatus and method to employ existing exhaust flow paired with enhanced hardware to control the fluid discharge temperature to an acceptable range.

BACKGROUND

Semiconductor manufacturing has historically used wet chemical stripping tools to remove flux from wafer surfaces for many years. This process had typically employed heated solvents (such as 1,3,5 trimethylbenzene) to strip the flux. These solvents served to execute the process but were not environmentally friendly. Advancements in flux technology created capable fluxes that could be stripped with more environmentally friendly chemistry (such as long chain alcohols). Continued refinement in flux technology has now yielded water soluble flux.

The process involved to remove water soluble flux for one wafer typically involves a ten minute DI (deionized water) flow rate of 2 LPM with a temperature of over 80° C. This water is used in a single pass. Semiconductor tools for volume manufacturing are built to process multiple wafers simultaneously. Accordingly, the large volume of hot DI employed to strip the flux yields the same large volume of heated DI going down the drain. Semiconductor fab facilities are typically not designed to handle these large volumes of heated fluids. Fab facilities sought to halt operations of the flux removal tool until the fluid discharge temperature could be brought down to an acceptable temperature.

Initial attempts were made to reduce the discharge fluid temperature to drain via dilution. The 2 LPM of 65° C. DI required 6 LPM of 25° C. DI to bring the temperature of the mixture to 35° C. This raised water usage volume (e.g., an increase of 3×) and was unacceptable. The use of a heat exchanger to have incoming water cool down the heated discharge stream was not possible. There was insufficient room within the tool to mount a large heat exchanger internally, also there was no unoccupied space in the immediate vicinity of the tool as it was installed inside the semiconductor lab. The energy being supplied for four chambers operating in parallel is some 30 kW. Mechanical refrigeration would require a large unit and be costly to install and operate with all of issues of the water heater exchanged previously noted.

In accordance with the present invention, the fluid discharge temperature was lowered into the acceptable range through the use of refrigerative exhaust. The 80° C. processing water dropped to 65° C. during the flux removal process. The 65° C. discharge fluid was introduced to the top of the existing main cabinet exhaust duct through one or more nozzles. The hot fluid discharge flowed down the exhaust duct, while ambient exhaust was pulled up through the duct at normal (310 SCFM) exhaust rates. Engineered internals placed within the duct enhanced the fluid/exhaust interface. Thus 30° C. cooling was obtained through sensible and latent heat loss from the discharge fluid and sensible heat gain from the exhaust (make up air warming as it was drawn through the exhaust duct) combined with mass transfer in the form of a small amount of water vapor being introduced into the exhaust stream. The largest piece of hardware required for this cooling operation is the exhaust duct, which was an existing piece of hardware within the tool. Accordingly, fitting in the support hardware was possible in the small amount of unoccupied space within the tool and no space external to the tool was required.

BRIEF DESCRIPTION OF THE DRAWING FIGURES

DETAILED DESCRIPTION OF CERTAIN EMBODIMENTS

Figure 1:
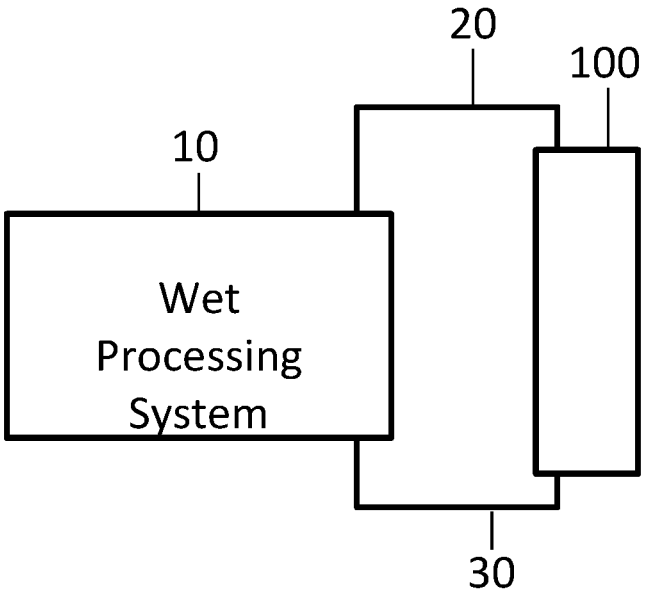
FIG. 1 is a schematic showing a wet processing system with an exhaust duct in accordance with one embodiment of the present invention.
Figure 3:
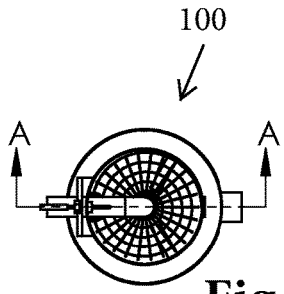
FIG. 3 is a top plan view of the exhaust duct.
Figure 2:
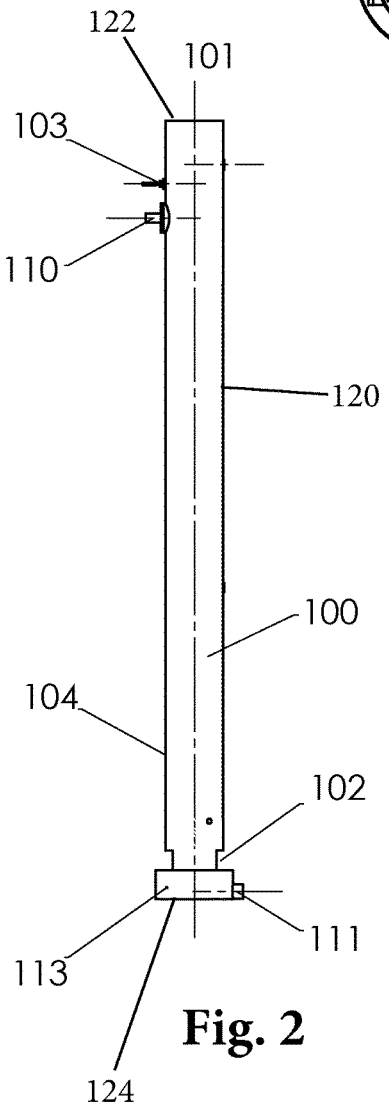
FIG. 2 is a side elevation view of one exemplary exhaust duct.
Figure 4:
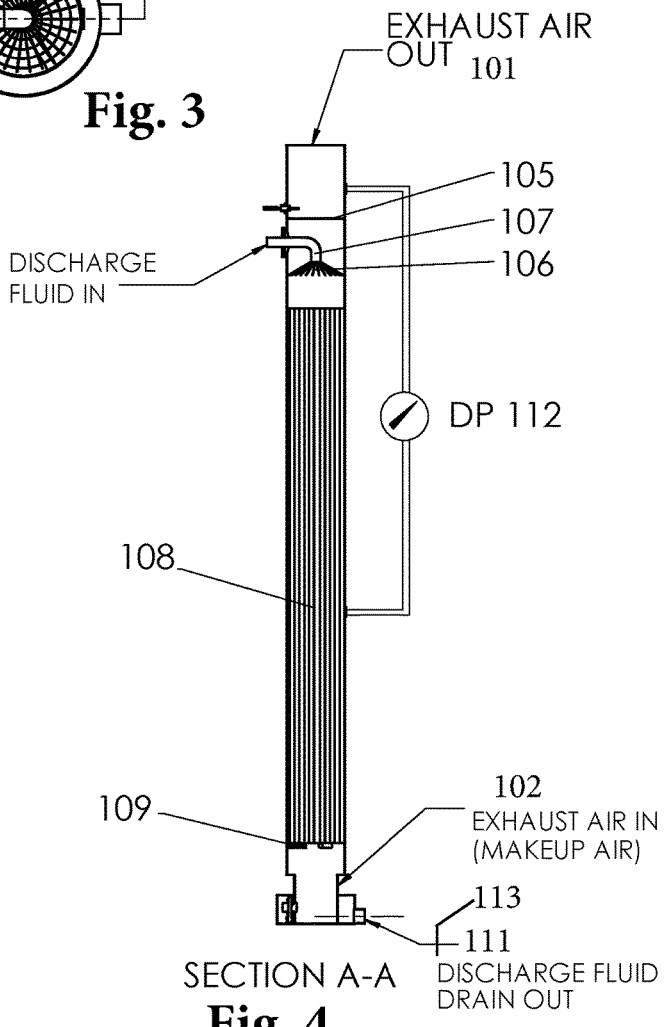
FIG. 4 is a cross-sectional view taken along line A-A of FIG. 3.

As shown in FIG. 1, an exhaust duct 100 in accordance with the present invention can be employed in a suitable wet processing system 10. Example wet processing systems are disclosed in U.S. patent application Ser. No. 13/780,657 filed on Feb. 28, 2013 and entitled "System and Method for Performing a Wet Etching Process", U.S. patent application Ser. No. 13/922,735 filed on Jun. 20, 2013 and entitled "Apparatus and Method for Challenging Polymer Films and Structures from Semiconductor Wafers", U.S. patent application Ser. No. 11/640,044 filed on Dec. 15, 2006 and entitled "Apparatus and Method of Chemical Separation", U.S. patent application Ser. No. 14/457,645 filed on Aug. 12, 2014 and entitled "Collection Chamber Apparatus to Separate Multiple Fluids During the Semiconductor Wafer Processing Cycle", and U.S. patent application Ser. No. 09/841,231 filed on Apr. 24, 2001 and entitled "Megasonic Treatment Apparatus", all of which are incorporated by reference herein in their entirety.

As shown in FIG. 1 and as described below, the wet processing system 10 is fluidly connected to the exhaust duct 100 and in particular, a first line or conduit 20 can carry a first fluid to the exhaust duct 100 and a second line or conduit 30 can carry a second fluid to the exhaust duct 100. In the illustrated embodiment, the first fluid comprises heated discharge fluid (e.g., heated chemistry discharged from the tool) and the second fluid comprises exhaust gas that is generated from the wet processing system 10.

The exhaust duct 100 has an elongated housing 120 having a first end 122 and an opposing second end 124. At a first end 122 of the housing, a top opening 101 is provided for discharging exhaust (exhaust out) and at or near the second end 124, a bottom opening 102 is provided and is in the form of an inlet for receiving a fluid, in this case exhaust air (makeup air from line 30). Temperature of the inlet air and outlet air is monitored through first and second sensors 103 and 104 (e.g., first and second thermocouples 103, 104), with the first thermocouple 103 being associated with the outlet air and the second thermocouple 104 being associated with the inlet air (exhaust gas (air) entering the duct). The second thermocouple is thus positioned to monitor the temperature of the exhaust gas as it enters the duct 100.

Discharge fluid at 65° C. (monitored through a temperature sensor 110, such as a thermocouple) is introduced through a dispense head 107 that is located just below a moisture retarding pad 105 and above a liquid distribution ring 106 which is configured to distribute the fluid (liquid) inside of the duct 100. The moisture retarding pad 105 is configured to take moisture out of the exhaust gas prior to exiting at outlet 101 and can be formed of any number of suitable materials, including stainless steel wool or a plastic strand equivalent. As shown, one end (a linear segment) of the dispense head 107 is located external to the duct 100 for receiving the discharge fluid. The liquid then flows down through the exhaust duct 100 with a portion of this fluid touching the duct itself, but the majority passes down through engineered internals 108 filling the space within the duct.

The engineered internals 108 are thus structures that are disposed internally within the duct 100 and define and increase surface area over which the fluid flows. The internals 108 extend in a longitudinal direction of the duct 100. The internals 108 can thus be thought of as defining a bed of material (e.g., column of material) though which both the discharge fluid and the exhaust gas flows. In bed form, the internals 108 comprises material that is disposed within a region of the duct 100 and in particular, the material is located within an intermediate region. Due to the shape thereof, the material defines interstitial spaces between the material and these interstitial spaces define areas in which both the discharge fluid and the exhaust can flow. The flow paths can thus be random in that the discharge fluid entering the top end of the bed can flow any number of different ways between the objects that form the bed. Similarly, the exhaust gas (whether it be pulled through the bed or pushed through the bed by application of positive pressure) flows between the objects that form the bed. The direct contact between the discharge fluid and the exhaust gas within the bed and over the length of the bed causes heat transfer and cooling of the discharge fluid.

It will be understood that both the width and the length of the bed influence the heat transfer process in that, as described herein, for longer beds, increased heat transfer occurs. In Examples discussed herein, the bed of material can have a length of about 3 feet, or about 4 feet, or about 5 feet or about 6 feet. These values are only exemplary and the bed can have other dimensions in part depending upon the size of the tool to which it is a part of.

Fluid discharged through ring 106 thus flows into contact with the internals (bed of material) 108 which are located below the ring 106. The ring 106 can thus direct the discharge fluid into the internals 108 instead of flowing along the inner wall of the housing that surrounds the internals 108. It will be appreciated that the bed defined tortuous flow paths for both fluids (i.e., both the discharge fluid and the exhaust gas). Due to the numerous interstitial spaces, the fluid can flow randomly through the material that forms the bed. The discharge fluid flows by gravity along surfaces of the material within the interstitial spaces until reaching the bottom of the bed which as described herein is configured such that that the discharge fluid can exit the bed and contact a drain floor or the like.

The internals 108 can be any material that redirect flow of both the exhaust air upwards and liquid flow downwards. The changing of direction of flow increases the interface between the discharge fluid and the exhaust gas. In other words, by flowing in a tortuous path, the fluid changes direction numerous times. In one embodiment, the internals 108 can be objects formed of stainless steel or comprised of many different plastics (e.g., polypropylene). Depending upon the size of the exhaust duct, many shapes work within the existing parameters. The material can have at least substantially uniform shapes, such as spheres (balls) that are disposed in a contained space, such as a column, to form a shaped bed of material, or can be formed of non-uniform shapes. The shapes of the material are such that the material does not pack in a compact manner and instead, is stacked and oriented such that the interstitial spaces are formed between the individual components (objects) of the material.

The pressure drop across the activation media (internals 108) will be displayed by a differential pressure gauge 112 (which is preferably in communication with a computer system). In that portion of the duct 100 filled with the engineered internals 108, the exhaust flow upward is forced to interact at a greater level with the discharge fluid flowing downward. This increased interaction results in a small portion of the liquid discharge joining the exhaust flow in vapor form, increasing the cooling of the discharge fluid. The discharge fluid will then reach the end of that portion of the duct 100 with engineered internals 108 and reach a lower support 109, which is the "foot" of the exhaust duct that holds the internals 108 up (i.e., elevated relative to the bottom floor of the duct 100) and it is also cut out on two sides to let the exhaust air into the duct 100 and permits the discharge fluid to travel by gravity to drain line 111. Here the discharge fluid will receive the final portion of cooling as it passes by the exhaust air inlet port 102 and ends up in a drain pan 113 and is then free to exit through the drain line 111. At this point, the discharge fluid exits the tool (duct 100) through the drain line 111 (the temperature of which is monitored through a thermocouple 113 at drain line 111).

The lower support 109 thus not only holds the bed of material but also has openings through which the discharge fluid flows and through which the exhaust gas flows. The openings are sized and shaped so that the material does not pass therethrough but both fluids do pass therethrough.

As shown in the figures, the differential pressure gauge 112 is configured to compare a first pressure in the exhaust duct 100 at a first location and a second pressure in the exhaust duct 100 at a second location. As illustrated, the first location is proximate the top opening 101 and the second location is a location between the two ends of the intervals 108.

In one exemplary embodiment, a method and appartus utilize the exhaust duct 100 with refrigerative exhaust to cool hot discharge fluid from a semioconductor manufacturing tool by placing the two in contact with one another in the different regions of the exhaust duct.

In another aspect of the exemplary embodiment, the exhaust duct 100 takes no additional space within the tool limits to accomplish the cooling.

In another aspect of the exemplary embodiment, the cooling requires no additional airflow above the designed flow for cabinet exhaust purposes.

In another aspect of the exemplary embodiment, temperature indicators (e.g., thermocouples) monitor the inlet and exit temperatures for both discharge fluid and exhaust flow.

In another aspect of the exemplary embodiment, the operation of the engineered internals 108 is monitored through the differential pressure gauge 112. As will be understood, flow through a pipe (or duct) will result in a pressure drop of the fluid (gas or liquid). When obstructions, such as the engineered internals (bed of material) 108, are placed in the pipe the pressure drop will be greater. The liquid flowing down will occupy space within the pipe and create additional pressure drop. The higher the flow of air or liquid, the higher the pressure drop. Accordingly, this parameter is effective at monitoring the conditions inside the duct. If the pressure drop strays outside of guidelines (an optimal range), an alarm can be generated so as to allow time to correct the issue prior to fluid discharge temperature getting out of range. In this way, the parameter acts as an early warning as to the operation of the exhaust duct 100. In other words, by monitoring the pressure within the duct 100, one can ascertain whether the temperature of the discharge fluid and/or exhaust gas is outside of norms.

In another aspect of the exemplary embodiment, no cooling water, mechanical refrigeration or substantial additional power is required to accomplish the cooling.

In another aspect of the exemplary embodiment, the apparatus can be scaled or modified to change performance goals in terms of temperatures obtained or flow rates handled.

In another aspect of the exemplary embodiment, the method and apparatus take no additional floor space outside the tool.

In another aspect of the exemplary embodiment, the method and apparatus uses both sensible and latent heat to cool the discharge fluid.

In another aspect of the exemplary embodiment, the sensible heat exchange occurs through the entire length of the duct.

In another aspect of the exemplary embodiment, as the discharge fluid flows through the engineered internals increased interaction between the discharge fluid and exhaust flow greatly increase the latent heat exchange.

In another aspect of the exemplary embodiment, a portion of the discharge fluid is vaporized due to contact with the exhaust gas. This adds a small amount of water vapor to the exhaust stream, while cooling the discharge stream from latent heat removal.

In another aspect of the exemplary embodiment, the unit can be scaled up or down.

In another aspect of the exemplary embodiment, changes to geometries will supply varying degrees of cooling nominally or in terms of efficiency. For instance, the longer the unit, the longer the interaction time will be. The longer the time (with no other design changes), the closer the approach (target) temperatures will be. In an Example 1, an air inlet of 20° C. and fluid outlet of 35° C. for a four feet bed. Assume for Example 2, all conditions the same and the bed is now six feet, the air inlet would remain at 20° C. but with the additional time in the longer bed, the fluid outlet would now be lower, e.g., 32° C. The same would happen on the other end in that the fluid inlet would remain 65° C. but the air would exit at a somewhat warmer temperature with the longer bed.

In another aspect of the exemplary embodiment, the described unit 100 works in vacuum (an exhaust stream is the air flow source). The design works so long as there is fluid flow and air flow. For the air flow, it could be air being drawn into the duct (the duct feeding a fan) and in this case the pressure inside the duct is in the vacuum range (lower than atmospheric pressure). In this scenario, the air is drawn up through the internals 108 (bed of material).

In another aspect of the exemplary embodiment, the unit will function in positive pressure. A pressurized stream of air being blown upward through the duct is suitable for operation. The other case is for a fan blowing air into the duct (positive pressure compared to atmosphere).

In another aspect of the exemplary embodiment, the unit is capable of functioning on non-volatile fluids. In this mode, the sensible heat removal will continue to cool the discharge fluid, although not to the same degree as if latent heat transfer occurs as well.

Notably, the figures and examples above are not meant to limit the scope of the present invention to a single embodiment, as other embodiments are possible by way of interchange of some or all of the described or illustrated elements. Moreover, where certain elements of the present invention can be partially or fully implemented using known components, only those portions of such known components that are necessary for an understanding of the present invention are described, and detailed descriptions of other portions of such known components are omitted so as not to obscure the invention. In the present specification, an embodiment showing a singular component should not necessarily be limited to other embodiments including a plurality of the same component, and vice-versa, unless explicitly stated otherwise herein. Moreover, applicants do not intend for any term in the specification or claims to be ascribed an uncommon or special meaning unless explicitly set forth as such. Further, the present invention encompasses present and future known equivalents to the known components referred to herein by way of illustration.

The foregoing description of the specific embodiments will so fully reveal the general nature of the invention that others can, by applying knowledge within the skill of the relevant art(s) (including the contents of the documents cited and incorporated by reference herein), readily modify and/or adapt for various applications such specific embodiments, without undue experimentation, without departing from the general concept of the present invention. Such adaptations and modifications are therefore intended to be within the meaning and range of equivalents of the disclosed embodiments, based on the teaching and guidance presented herein. It is to be understood that the phraseology or terminology herein is for the purpose of description and not of limitation, such that the terminology or phraseology of the present specification is to be interpreted by the skilled artisan in light of the teachings and guidance presented herein, in combination with the knowledge of one skilled in the relevant art(s).

While various embodiments of the present invention have been described above, it should be understood that they have been presented by way of example, and not limitation. It would be apparent to one skilled in the relevant art(s) that various changes in form and detail could be made therein without departing from the spirit and scope of the invention. Thus, the present invention should not be limited by any of the above-described exemplary embodiments, but should be defined only in accordance with the following claims and their equivalents.

What is claimed is:

1. In a wet processing system having an exhaust line carrying exhaust gas and a heated fluid discharge outlet line carrying heated discharge fluid, an exhaust duct comprises:

a housing having a hollow interior, wherein the housing has a first inlet for receiving a first fluid, a second inlet for receiving a second fluid, a first outlet for discharging the first fluid after it has traveled through the housing, and a second outlet for discharging the second fluid after it has traveled through the housing, wherein the housing has a first internal region at a first end of the housing, an intermediate region, and a second internal region at a second end of the housing, the intermediate region of the housing containing internals that define a plurality of flow paths within the intermediate region and increase a surface area over which the first fluid and second fluid flow and contact one another, wherein the first inlet and second outlet are located in the first internal region and the second inlet and first outlet are located in the second internal region.

2. The wet processing system of claim 1, wherein the first fluid comprises the heated discharge fluid and the second fluid comprises the exhaust gas.

3. The wet processing system of claim 1, wherein the first inlet includes a dispense head and a fluid distribution ring that is configured to distribute the heated discharge fluid inside of the housing.

4. The wet processing system of claim 3, wherein the dispense head is configured and positioned such that a majority of the first fluid passes through the internals along the plurality of flow paths.

5. The wet processing system of claim 3, wherein the first internal region includes a moisture retarding pad disposed between the dispense head and the second outlet, the moisture retarding pad being configured to allow the second fluid to pass therethrough and flow to the second outlet.

6. The wet processing system of claim 5, wherein the first internal region includes a first sensor for measuring a temperature of the second fluid within the first internal region and second sensor is provided for measuring a temperature of the second fluid entering the housing through the second inlet, and wherein a third sensor associated with the first inlet is provided for measuring a temperature of the first fluid as it enters the housing through the first inlet.

7. The wet processing system of claim 6, further including a fourth sensor for measuring a temperature of the first fluid exiting the housing through the first outlet.

8. The wet processing system of claim 7, wherein each of the first sensor, second sensor, third sensor, and fourth sensor comprises a thermocouple.

9. The wet processing system of claim 1, wherein the internals comprise a bed of material that defines interstitial spaces between the material, the interstitial spaces in part defining the plurality of flow paths in which both the first fluid and second fluid flow, the first and second fluids being in contact with one another.

10. The wet processing system of claim 9, wherein the flow paths comprise tortuous flow paths over which both the first fluid and second fluid flow.

11. The wet processing system of claim 1, wherein both the first fluid and the second fluid flow along the plurality of flow paths in opposite directions within the housing.

12. The wet processing system of claim 1, wherein within the second internal region, the second inlet is closer to the internals compared to the first outlet.

13. The wet processing system of claim 1, further including a pressure differential device for monitoring operation of the internals.

14. The wet processing system of claim 13, wherein the pressure differential device monitors a pressure of the second fluid within the first internal region and a pressure within the internals, thereby allowing a pressure drop across the internals.

15. The wet processing system of claim 1, wherein the second fluid comprises refrigerative exhaust which cools the heated discharge fluid by contact therewithin.

16. The method of claim 15, wherein the internals comprise a bed of material that defines interstitial spaces that define the plurality of flow paths in which both the first fluid and second fluid flow, the first and second fluids being in contact with one another within the bed of material.

* * * * *